United States Patent [19]

Gunduz et al.

[11] 4,435,063

[45] Mar. 6, 1984

[54] AUTORADIOGRAPHY METHOD USING A SLIDE RACK

[75] Inventors: Nurten N. Gunduz; Dincer H. Gunduz, both of Pittsburgh, Pa.

[73] Assignee: University of Pittsburgh, Pittsburgh, Pa.

[21] Appl. No.: 216,295

[22] Filed: Dec. 15, 1980

[51] Int. Cl.[3] ..... G03D 13/08

[52] U.S. Cl. ..... 354/315; 354/297; 354/344; 427/2; 430/401

[58] Field of Search ..... 354/297, 340, 344, 315, 354/316, 307; 424/1, 1.5, 3; 430/17, 401, 432, 370; 427/2; 356/244

[56] References Cited

U.S. PATENT DOCUMENTS

| | | | |
|---|---|---|---|
| 887,055 | 5/1908 | Barnes et al. | 354/315 |
| 923,669 | 6/1909 | Lavender | 354/307 |
| 996,198 | 6/1911 | Barrack | 354/307 |
| 2,190,754 | 2/1940 | Carleton | 354/307 |
| 2,603,755 | 7/1948 | Ment | 430/17 |
| 3,165,049 | 1/1965 | Dick | 354/311 |
| 3,891,327 | 6/1975 | Welch | 356/246 |
| 4,029,470 | 6/1977 | Wilkins et al. | 8/94.11 |
| 4,085,331 | 4/1978 | Thackray | 430/432 |
| 4,103,041 | 7/1978 | Macho | 427/2 |
| 4,120,991 | 10/1978 | Ornstein et al. | 427/2 |
| 4,147,423 | 4/1979 | Sayre | 354/340 |
| 4,188,107 | 2/1980 | Mitchell | 354/344 |

OTHER PUBLICATIONS

Fisher Scientific Co. Catalog, 1979, p. 575.

*Primary Examiner*—L. T. Hix
*Assistant Examiner*—Alan Mathews
*Attorney, Agent, or Firm*—Buell, Blenko, Ziesenheim & Beck

[57] ABSTRACT

A method of processing specimens including securing the specimens to a plurality of slide members and providing a rack member having separators defining a plurality of slide receiving slots. Introducing the slides into the slots and immersing the slides while in the rack member into a bath of photographic emulsion, withdrawing the rack member from the bath and drying the emulsion, exposing the emulsion-covered slides while in the rack and developing the exposed slides. The autoradiography apparatus provides a rack member for holding a multiplicity of specimen-bearing slides with the rack member having a base portion, an upper portion and a connecting portion. The base portion has a plurality of upwardly projecting spaced first separator members defining a series of first slide-receiving slots and the upper portion has a plurality of spaced second separating members defining a series of second slide-receiving slots generally aligned with the first receiving slots. In one embodiment the first separator members project generally upwardly from the base portion and the second separator members project generally laterally inwardly from a peripheral wall of the upper portion.

7 Claims, 8 Drawing Figures

AUTORADIOGRAPHY METHOD USING A SLIDE RACK

BACKGROUND OF THE INVENTION

1. Field of the Invention

This invention relates to an improved method and improved apparatus for autoradiography.

2. Description of the Prior Art

As used herein, the word "specimen" shall mean human, animal, plant and bacterial cells, tissues or other samples obtained from a human, animal or plant and which are to be analyzed for medical or research purposes.

It has been known in many fields to provide specimens on slides, such as glass microscope slides, for study purposes. It is also known to label such specimens with various radioactive materials. The presence of radioactive binding to specimen can be determined. Under known practices, the specimen bearing slides are individually, manually engaged on the frosted end and each is individually dipped into a photographic emulsion and subsequently placed in a drying rack. Not only is this a time-consuming process when a large number of slides are to be processed, but also wet hands of the individual performing the test causes the fingers to lose their sensitivity for detecting the frosted ends of the slide. As a result, frequently undesired dipping of the frosted end into the emulsion occurs. Similarly, individual placement of the dipped slides into the drying rack is a time consuming procedure which often results in inadvertent sticking of slides to each other or slides being dropped or the emulsion surface being damaged through undesired contact with fingers, other slides, rack portions or other objects. Further, if slides are overdried while in the drying rack, it becomes difficult, if not impossible, to remove them from the rack.

Under known practices, after the slides have dried in the drying rack they are stored in light-proof boxes. This requires individual removal of the slides from the drying rack in an environment of total darkness and placing the slides vertically in narrow slots in the light-proof boxes. The boxes are then taped around the edges or wrapped with aluminum foil to resist light leakage. The sealed box containing the specimen bearing, emulsion coated slides is then introduced into a refrigerator for exposure. Typically, the sealed box is introduced into a refrigerator having a temperature of about 4° C. and, depending on the type of study being performed, is left there for about one day to six months. During this period in the sealed box, the radio-active material emits energy, such as alpha or beta particles or gamma rays, which reduces silver bromide in the photographic emulsion to metallic silver. The exposure is generally done at 4° C. in order to minimize undesired background. Also, the box is sealed during exposure to avoid undesired exposure of the emulsion to light which would tend to ruin the slide.

After the desired exposure, each slide must be removed from the black or light-proof box and placed vertically in glass trays for development. This practice requires not only extensive individual handling of the slides, but also that the slides not be permitted to touch each other. It is generally not possible to fill such a tray while avoiding slides being stuck together and, as a result, efficient placement of slides in such a tray generally occurs with respect to less than the full capacity of the tray thereby resulting in waste of the worker's time as well as developer, stopper and fixing solutions.

As a result of the above-described problems, it is customary in many types of tests to prepare and process several slides of the same specimen in order to improve the chances of obtaining an acceptable result.

There remains, therefore, a substantial need for improved means of processing such specimen-bearing slides.

SUMMARY OF THE INVENTION

The present invention has met the above-described need by providing for autoradiography methods and apparatus which substantially minimize the amount of individual slide handling involved in processing autoradiography specimens.

The apparatus of the present invention includes a rack member which has means for holding a multiplicity of specimen-bearing slides throughout the emulsion-coating stage, the drying stage, the storage stage, the exposure and developing stages. This apparatus not only minimizes the amount of labor required to process a group of slides, but results in more efficient processing with better results. The rack member has a base portion, an upper portion and a connecting portion with a plurality of first separator members and a plurality of second separator members defining a plurality of aligned slots on the upper portion so as to permit effective securement of the slides out of contact with each other and out of undesired contact with portions of the rack member.

The method of the present invention provides for securing of the specimens to slides and positioning the specimen-bearing slides in the slots of the rack member. The rack member is immersed in a photographic emulsion bath and removed therefrom after which drying of the slides is permitted. The slides are stored in a reduced light environment and are subsequently exposed to a refrigerated environment while in the rack. Developing, and if desired, staining may also take place while the slides are in the rack.

It is an object of the present invention to provide autoradiography methods and apparatus which facilitate efficient processing of specimen-bearing slides while involving substantially reduced workers' time and individual slide handling.

It is another object of the present invention to provide such a method and apparatus which are compatible with medical or other objectives in respect of quality of the resultant exposed and developed specimen bearing slides.

It is a further object of this invention to provide such apparatus which may be economically manufactured and used and, if desired, be made so as to be disposable.

These and other objects of the invention will be more fully understood from the following description of the invention, on reference to the illustrations appended hereto.

DESCRIPTION OF THE PREFERRED EMBODIMENT

Figure 1:
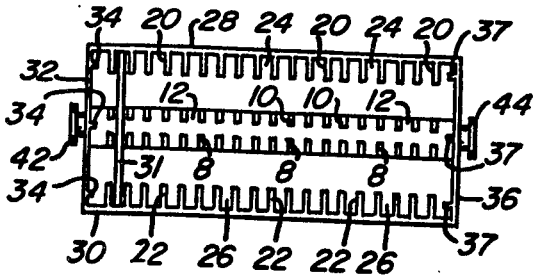
FIG. 1 is a top plan view of a preferred form of rack member of the present invention.
Figure 2:
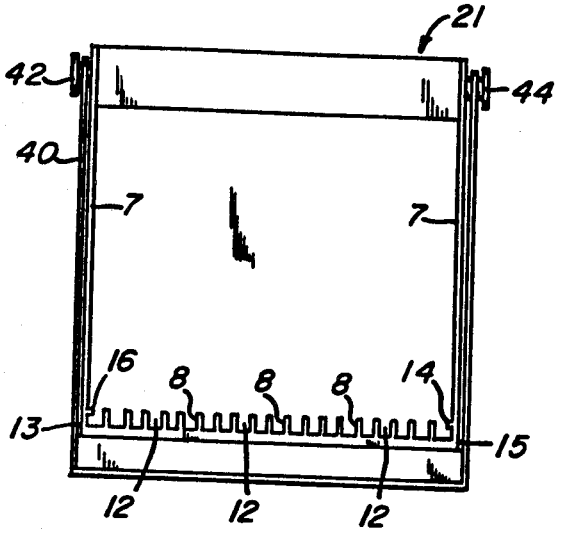
FIG. 2 is a front, partially broken away elevational view of the rack member of FIG. 1.
Figure 3:
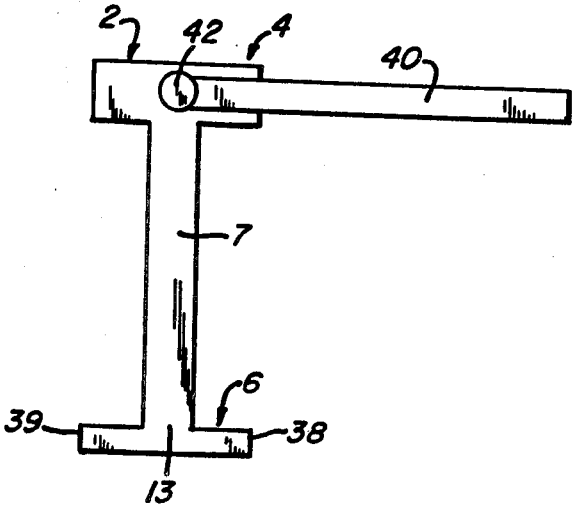
FIG. 3 is a side elevational view of the rack member of FIG. 1.

Referring now to FIGS. 1 through 3 in greater detail, there is shown a preferred form of rack member 2 which has an upper portion 4, a lower portion 6 and a connecting portion 7.

As is shown in FIGS. 1 and 2, the base portion, has two rows of separators 8, 10 of generally identical size and shape with the separators of any one row being generally aligned with the other separators in said row in a longitudinal direction and each pair of adjacent separators 8, 10 being aligned in a lateral direction. It will be appreciated that each pair of adjacent separators 8 cooperating with their aligned adjacent separators 10 defines a slot 12. The width of slot 12 is so established as to permit ready insertion and removal of the slides while permitting generally firm retention of the slide within the slot 12 during processing.

The lower portion 6 preferably has generally the shape of an upwardly open box defined by a pair of sidewalls 38, 39, and a pair of endwalls 13, 15. It is preferred that these walls 13, 15, 38, 39 project upwardly farther than the upward extent of the separators 8, 10. The sidewalls 38 (sidewall 38 has been omitted in FIG. 2 for clarity of illustration of separators 8), 39 serve to resist undesired sliding movement of the slides out of the slots 12.

Referring now to FIG. 2, it will be noted that where the connector portion 7 merges into endwalls 13, 15 there are provided generally inwardly projecting spacer elements 14, 16 respectively. These serve to contact the slides in the end slots and resist undesired contact between the slide surface and the surface of connecting portion 7. It is preferred that two or three spacer elements 14, 16 be provided on each side at the same elevation, spaced from each other.

It will be noted that as a result of positioning of separators 8, 10, generally inwardly from sidewalls 38, 39 the slots 12 in the bottom portion are generally centrally positioned on portion 6.

Referring now in greater detail to FIG. 1, the slots provided in the upper portion 4 will be considered in greater detail. The upper portion has a series of peripheral walls including sidewalls 28, 30 and endwalls 32, 36. A series of separator members 20 projecting generally inwardly from sidewall 28 define a series of slots 24. Similarly, a series of separators 22 projecting generally inwardly from sidewall 30 define a series of slots 26. It will be appreciated that the slots 24, 26 are not only aligned with each other, but also are aligned with slots 12 formed in base portion 6. In this fashion, a slide such as slide 31 may be introduced into the slide rack by sliding action from above the rack causing the slide 31 to first have its opposed edges enter one slot 24 and one slot 26 and under guidance of these slots travel downwardly until its lower extremity enters slot 12.

Referring still to FIG. 1, it is noted that end-wall 32 has a number of generally inwardly projected separators or spacers 34 which serve to resist undesired surface-to-surface contact between a slide in the adjacent slot and surface of endwall 32. Similarly, a number of inwardly projecting spaces 37 are provided on endwall 36.

It will be appreciated that by use of this rack member 2 slides may readily be introduced into secure positions where they are not contacting each other and are engaged solely at their upper and lower portions thereby not involving undesired contact on the emulsion-covered specimen-bearing sections.

In a preferred embodiment of the invention, the slots 12, 24, 26 have a width of about 1.5 to 2.5 times the thickness of the slides the slots are adapted to receive so as to minimize the risk of damaging contact between the slides and separators 8, 10, 20, 22. The preferred slot width is about 2 times the slide thickness.

It is preferred that the upper portion 4 have a height of about 8 to 13 mm and that the separators 20, 22 be so spaced with respect to the base of slots 12 that when the slides are in place in the rack member 2, the separators 20, 22 will contact the frosted portions of the slides. The separators 20, 22 preferably have a height of about 6 to 12 mm. Lower separators 8, 10 preferably have a height of about 2 to 4 mm.

A generally U-shaped handle member 40 is provided in order to facilitate ready handling of the rack member 2. In the form shown, the handle 40 has its opposed ends pivotally secured to pivots 42, 44 which are disposed on opposed ends of upper portion 4. The handle 40 provides a convenient means for engaging the rack member 2 for handling, while permitting movement to the position shown in FIG. 2 for storage or insertion into a light box. The height of handle 40 measured from pivots 42, 44 is greater than the spacing between the lower portion 6, lower surface and pivots 42, 44.

In a preferred embodiment of the invention it is contemplated that the rack member 2 may economically be made of a suitable material so as to be disposable. Among the preferred materials are generally chemically inert plastic resins and protectively coated metals. It is specifically preferred that the material be relatively inert in the presence of hydrochloric acid, ethanol, methanol, xylene and acetone.

Figure 4:
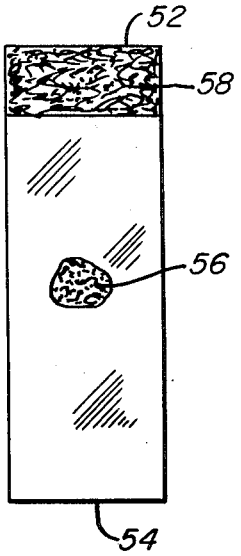
FIG. 4 is a schematic representation of a specimen-bearing slide.

Referring now to FIG. 4, there is shown schematically a form of slide adapted to be processed by the present invention. The slide 50 has a upper end 52 and a lower end 54 with a specimen 56 secured generally centrally on the slide. The upper portion of slide 50 has a frosted portion 58. In placing the slide 50 in the rack member 2, the lower end 54 will be received within a slot 12 and the frosted portion 58 will be secured within a slot 24 and a slot 26. One conventional type of slide has a height of about 7.5 mm, a width of about 2.5 mm and a thickness of about 1 mm.

The partition members 8, 10 may preferably be of substantially uniform thickness. If desired, the upper extremities of partition members 8, 10 may be tapered or otherwise of restricted thickness so as to function as pilot surfaces to assist with guiding of slides into slots 12. Such departures from uniform thickness shall for simplicity of disclosure herein be deemed to keep the partition of substantially uniform thickness. It is preferred that the elongated sidewalls of partition members 8, 10 when viewed in elevation be substantially rectangular.

Figure 5:
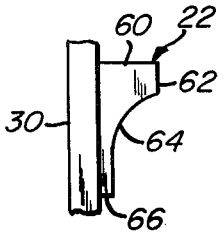
FIG. 5 is a fragmentary view of a form of preferred separator member usable in the present invention.

Referring to FIG. 5 there is shown a preferred construction for an upper separator member 22 or 24. As is shown, the separator member 22 is secured to peripheral wall 30. This separator member 22 preferably has a substantially uniform thickness equal to the thickness of separators 20, 8 and 10. In the form illustrated, separator 22 does not have a generally rectangular side elevational configuration. It has an upper surface 60 which projects outwardly about three to five times the extent of the outward projection of lower surface 66. It has a vertical surface 62 and a transitional surface 64. With the bulk of the separator 20, 22, its upper extremity, maximum retention capability in respect of undesired slide movement is achieved while minimizing the likelihood of objectionable contact between the separator portions of the slide below the frosted section 58.

Figure 6:
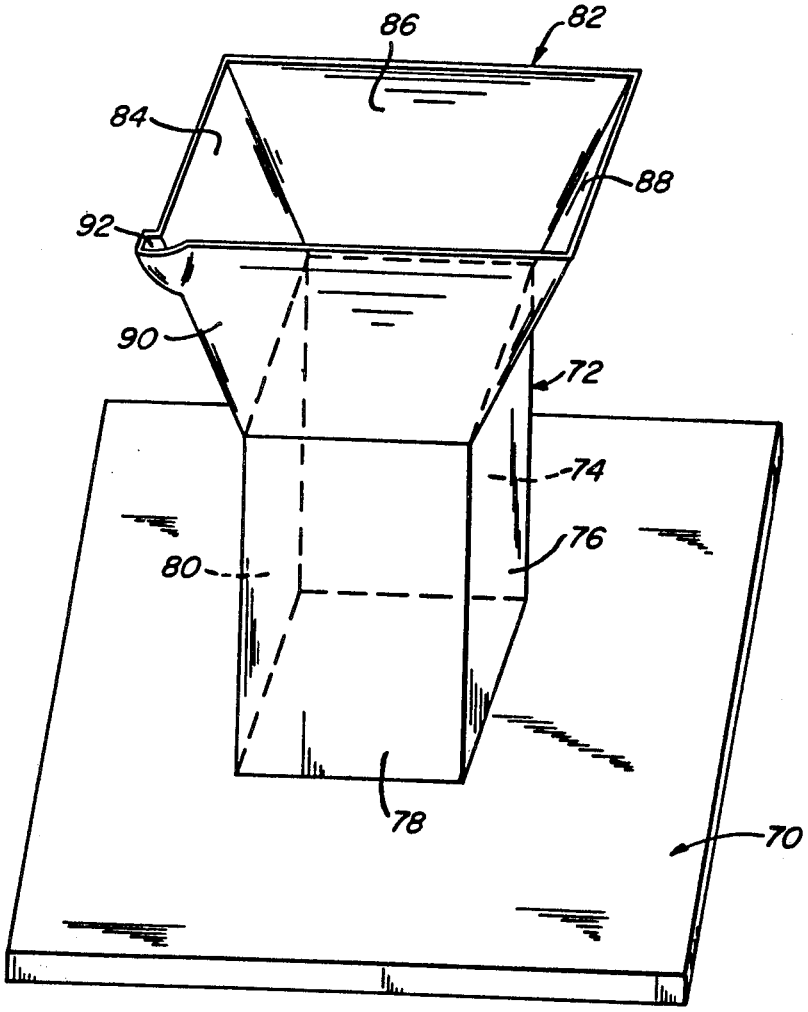
FIG. 6 is a partially schematic, perspective view of a form of reservoir means of the present invention.

Referring now to FIG. 6, there is shown a form of reservoir means adapted for use in the present invention. It consists of a base portion 70 which is generally rectangular, and in the form shown, of substantially greater cross-sectional extent in plan than the overlying fluid reservoir 72. This relationship minimizes the risk of undesired tipping of the fluid reservoir 72. The fluid reservoir 72 is defined by walls 74, 76,78, 80 and is either formed integrally with base portion 70 or is secured in liquid-tight relationship thereto. Overlying and preferably secured to fluid reservoir 72 is pilot portion 82 which is formed by walls 84, 86, 88, 90 which converge downwardly toward the upper extremity of fluid reservoir 72. It is noted that a pour spout 92 is integrally formed at the juncture of walls 84, 90.

In a preferred practice of the invention, the slides are introduced into the various slots of the rack member 2. After this introduction has been accomplished the user grasps the handle 40 and immerses the lower portion 6 and connecting portion 7 into fluid reservoir 72 which contains a bath of emulsion. The emulsion generally is coated on the slides up to the frosted portion. The rack member 2 is then lifted from the reservoir 72 and the emulsion-coated slides are permitted to dry at room temperature. It will be appreciated that the pilot portion 82 serves to facilitate introduction of the rack member 2 into the reservoir 72 and also serves to return to the reservoir emulsion which might drip off of the slides during withdrawal of the rack member 2. Finally, emulsion remaining in the reservoir 72 after processing may conveniently be restored to a storage container through pour spout 92.

Figure 7:
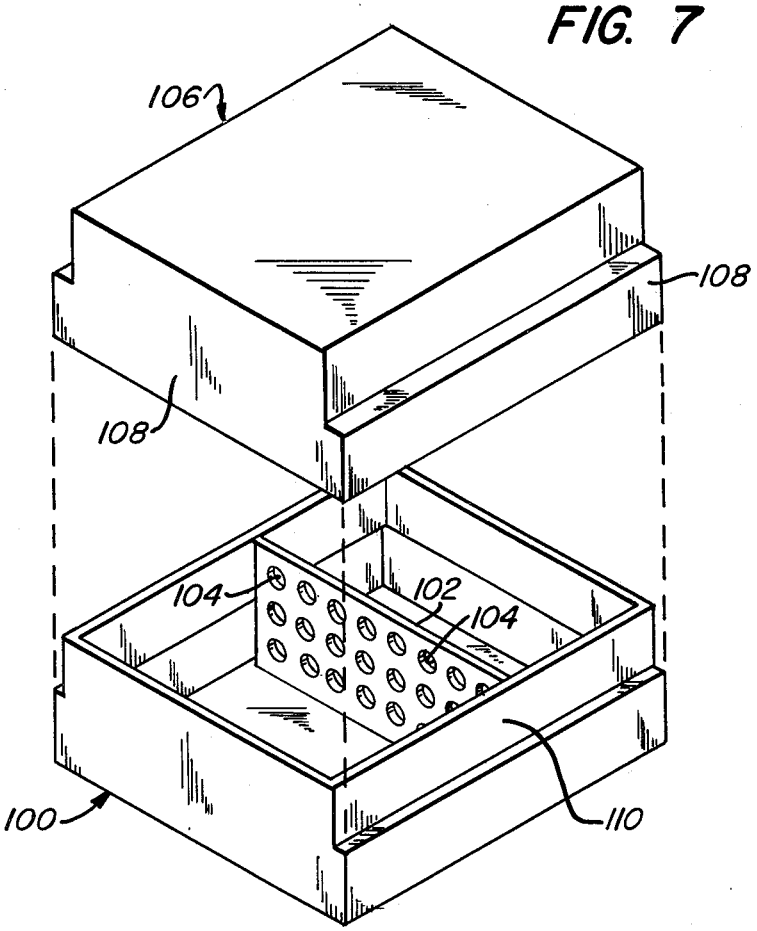
FIG. 7 is an exploded view of a form of light-tight container employable in the present invention.

FIG. 7 illustrates a form of light-tight box which consists of a base portion 100 and a lid 106. The box may advantageously be made of a black plastic material, but other suitable types of boxes may be used. A separator plate 102 containing a series of openings 104 is provided in the box. In use, the rack member 2 with the handle in the position shown in FIG. 2 is placed in the base portion 100 on one side of separator plate 102 and a suitable dessicating agent such as $CaSO_4$ is positioned in the base portion on the other side of plate 102. The openings 104 permit absorption of moisture by the dessicating agent and help further dry the slides during the exposure period. A suitable dessicating agent is that sold under the trade designation Dri-Rite. In order to improve the light-tight characteristics of the box it is preferred that the upper edge of base portion 100 contains an inwardly offset upwardly projecting flange 110 which cooperates with an outwardly offset downwardly projecting overlapping flange 108 of the lid 106. If desired, tape or foil may be placed over the overlapping flange members 108, 110 in order to provide further resistance to undesired entry of light into the box.

Figure 8:
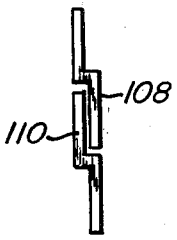
FIG. 8 is a fragmentary, cross sectional illustration of the lid-bottom connection of the container of FIG. 7.

In practicing the present invention with use of a light-tight container of that type shown in FIGS. 7 and 8, the rack member 2 containing emulsion-bearing dried slides may be introduced into the box and the box closed. The box may be introduced into a refrigerated environment at about 4° C. The radioactive material which was incorporated within the specimen emits alpha particles, beta particles or gamma rays. This energy reduces the silver bromide (AgBr) in the photographic emulsion to metallic silver. The refrigerated environment not only reduces undesired background on the slides, but also serves to resist distortion and shrinkage of the specimen. After this exposure for a predetermined period of time, the slides while retained in the rack are developed either by conventional autoradiography techniques or by gold-activated autoradiography. In the former process, red lights are generally employed, while in the latter developing is effected in complete darkness. After developing has been completed, the slides may be removed from the rack member. If it is desired to stain the slides, this may be done while the slides are in the rack before or after developing.

It will be appreciated that by the method and apparatus of the present invention, the specimen-containing slides need merely be introduced into the rack member initially and the processes of emulsion coating, drying, storage in a light-free container, slide exposure, slide development and staining may all be accomplished without further individual handling of the slides. In addition, risk of damage to the slides through repeated handling in a darkroom is eliminated thereby producing improved quality of result in addition to improved efficiency of processing. Further, if desired, staining may be accomplished while the slides are in the rack member. Further, the rack member may be made of a material which makes it economical to dispose of after use.

While for purposes of simplicity of disclosure, a specific preferred form of apparatus and method have been disclosed, it will be apparent that other forms may be provided. For example, a rack member adapted to hold more or less than the number of slides illustrated may be provided. Also, should it be desired, the partition members on the base portion may be positioned immediately underlying the partition members on the upper portion or at an intermediate position.

Whereas particular embodiments of the invention have been described above for purposes of illustration, it will be evident to those skilled in the art that numerous variations of the details may be made without departing from the invention as defined in the appended claims.

We claim:

1. A method of processing specimens comprising securing said specimens to a plurality of slide members, providing rack means having separators defining a plurality of slide-receiving slots, introducing said slides into said slots, immersing said slides while in said rack in a bath of photographic emulsion, removing said rack from said bath, exposing said emulsion-covered slides to radiation while said slides are in said rack, developing said exposed slides, and removing said developed slides from said rack, whereby said specimen-bearing slides will be coated with emulsion, exposed and developed without the need for individual handling of said slides after initial introduction of said slides into said rack.

2. The method of processing specimens of claim 1 including retaining said slides in relative noncontacting relationship with respect to each other while in said rack.

3. The method of processing specimens of claim 2 including after removing said rack from said emulsion bath and prior to exposing said slides, drying said emulsion on said slides.

4. The method of processing specimens of claim 3 including after drying said emulsion introducing said rack into a substantially light-tight container.

5. The method of processing specimens of claim 4 including after introducing said rack into said substantially light-tight container, introducing said container into a refrigerated environment and effecting said exposing of said emulsion-covered slides within said refrigerated environment.

6. The method of processing specimens of claim 5 including after exposing said slides, removing said rack from said substantially light-free container, and effecting said developing of said slides within said rack.

7. The method of processing specimens of claim 6 including staining said slides prior to removing said slides from said rack.

* * * * *